US009352391B2

(12) United States Patent
Woodward et al.

(10) Patent No.: US 9,352,391 B2
(45) Date of Patent: May 31, 2016

(54) PROCESS FOR CASTING A TURBINE WHEEL

(71) Applicant: Honeywell International Inc., Morristown, NJ (US)

(72) Inventors: John Woodward, Somerset (GB); Paul Bedford, Devon (GB)

(73) Assignee: Honeywell International Inc., Morris Plains, NJ (US)

( * ) Notice: Subject to any disclaimer, the term of this patent is extended or adjusted under 35 U.S.C. 154(b) by 74 days.

(21) Appl. No.: 14/048,693

(22) Filed: Oct. 8, 2013

(65) Prior Publication Data

US 2015/0096710 A1 Apr. 9, 2015

(51) Int. Cl.

| | |
|---|---|
| ***B22D 27/20*** | (2006.01) |
| ***B22D 25/02*** | (2006.01) |
| ***B22C 9/04*** | (2006.01) |
| ***B22D 15/00*** | (2006.01) |
| ***B22D 21/02*** | (2006.01) |

(Continued)

(52) U.S. Cl.

CPC . *B22D 27/20* (2013.01); *B22C 9/04* (2013.01); *B22D 15/00* (2013.01); *B22D 21/025* (2013.01); *B22D 25/02* (2013.01); *C22C 19/056* (2013.01); *C22C 19/07* (2013.01)

(58) Field of Classification Search

CPC ..... B22D 23/00; B22D 25/02; B22D 27/20
USPC ..... 164/47, 121, 122.1, 122.2
See application file for complete search history.

(56) References Cited

U.S. PATENT DOCUMENTS

| | | | | |
|---|---|---|---|---|
| 4,240,495 A | | 12/1980 | Vonnegut | |
| 4,412,577 A | * | 11/1983 | Salkeld et al. | 164/122.2 |
| 4,436,485 A | | 3/1984 | Vonnegut | |

(Continued)

FOREIGN PATENT DOCUMENTS

| | | |
|---|---|---|
| DE | 645105 C | 5/1937 |
| DE | 10209347 A1 | 9/2003 |

(Continued)

OTHER PUBLICATIONS

Woulds, M, et al.; "*Development of a Conventional Fine Grain Casting Process*;" AiResearch Casting Company; dated Jun. 1984; retrieved on Oct. 29, 2013 from <http://www.tms.org/superalloys/10.7449/1984/Superalloys_1984_3_12.pdf>.

(Continued)

*Primary Examiner* — Kevin P Kerns
(74) *Attorney, Agent, or Firm* — John C. James

(57) ABSTRACT

A process for casting a turbine wheel includes steps of identifying a metal composition from which the turbine wheel is to be cast, providing a mold that defines a cavity into which molten metal composition is to be poured for casting the wheel, providing a seed member made of the metal composition and having an equiaxed grain structure, disposing at least a portion of the seed member within the cavity of the mold, pouring the molten metal composition into the cavity such that the molten metal composition envelops the portion of the seed member within the cavity, and controlling the process so that the portion of the seed member at least partially melts through contact with the molten metal composition and so that, upon cooling, the metal composition around the seed member solidifies with an equiaxed grain structure as precipitated by the equiaxed grain structure of the seed member.

10 Claims, 5 Drawing Sheets

(51) Int. Cl.
*C22C 19/07* (2006.01)
*C22C 19/05* (2006.01)

(56) References Cited

U.S. PATENT DOCUMENTS

| | | | | |
|---|---|---|---|---|
| 4,714,101 | A * | 12/1987 | Terkelsen | 164/122.2 |
| 4,813,470 | A | 3/1989 | Chiang | |
| 5,275,228 | A * | 1/1994 | Wortmann et al. | 164/122.2 |
| 5,931,214 | A | 8/1999 | Spicer et al. | |
| 6,497,272 | B1 * | 12/2002 | Maslen | 164/516 |
| 2002/0185247 | A1 * | 12/2002 | Schaadt et al. | 164/122.2 |
| 2005/0025613 | A1 * | 2/2005 | Strangman | 415/1 |
| 2005/0211408 | A1 * | 9/2005 | Bullied et al. | 164/122.2 |
| 2005/0249602 | A1 * | 11/2005 | Freling et al. | 416/241 B |
| 2008/0003447 | A1 * | 1/2008 | Nee | 428/615 |
| 2010/0304161 | A1 * | 12/2010 | Huang et al. | 428/469 |
| 2013/0171020 | A1 * | 7/2013 | Bullied et al. | 420/591 |

FOREIGN PATENT DOCUMENTS

| | | |
|---|---|---|
| GB | 2462275 A | 3/2010 |
| JP | 2000061613 A | 2/2000 |

OTHER PUBLICATIONS

"*Standard Practice for Microetching Metals and Alloys*;" ASTM International—Designation E407-07; pp. 1-22; dated Sep. 2012.

EPO Search and Opinion dated Feb. 19, 2015 for Appl. No. 14185134.5-1362.

* cited by examiner

PROCESS FOR CASTING A TURBINE WHEEL

BACKGROUND OF THE INVENTION

The present disclosure relates generally to the manufacture of turbine wheels, and more particularly relates to the casting of turbine wheels.

Turbine wheels in turbomachinery (e.g., gas turbine engines, turbochargers, and the like) operate in extremely challenging environments. The high temperature of the gases passing through the wheel, combined with the high rotational speeds typically experienced, result in severe testing of the strength and/or fatigue-resistance limits of the material from which the wheel is made. At the speeds and temperatures reached by turbocharger turbine wheels, for instance, the strength limit of the wheel material becomes crucial for durability and safety. Turbo shaft speed can sometimes climb to over 200,000 rpm for smaller units, and even the largest turbochargers can reach 90,000 rpm. Turbine wheels can reach 1800° F. (980° C.) and higher in typical turbocharged vehicles, and in top-level motorsports such as WRC they can regularly get up to 1950° F. (1050° C.). The centrifugal stress that the wheel must resist is proportional to the rotational speed squared, and the strength of typical wheels falls off drastically at temperatures above their qualified limits. Wheels are designed to resist these stresses at high temperatures but there is always a limit; a combination of high speed and high temperature increases the possibility of a wheel burst.

There are two basic types of wheel burst: blade and hub. A blade burst occurs when the centrifugal force at speed acting to pull the blades off of the central hub overcomes the mechanical strength of the root sections connecting the individual blades to the hub. Under these conditions if a blade root is too weak it could leave the hub. Hub burst, on the other hand, is the case wherein the main hub that the blades are attached to reaches its ultimate strength limit and breaks into two, three or more large pieces through the centerline of the wheel. The hub is more compact than the blades and is a continuous mass, therefore stronger than the root of each thin blade. However, the hub centerline is at the rotational centerline of the wheel, meaning that the internal stresses are at their maximum at the hub's core. The hub can actually burst at extreme speeds and temperatures.

It has been understood by those working in the turbine wheel field that a fine equiaxed grain structure in the wheel hub is beneficial for reducing the likelihood of hub burst under extreme conditions. Accordingly, various fine-grain casting processes for turbine wheels have been developed.

BRIEF SUMMARY OF THE DISCLOSURE

The present disclosure describes a process for investment casting of a turbine wheel having a fine equiaxed grain structure in the hub region of the wheel. In accordance with one aspect of the process as disclosed herein, first a metal composition from which the turbine wheel is to be cast is identified. For example, the wheel may be cast from a nickel-based superalloy composition. Next, there is provided a mold that defines a cavity into which the metal composition in molten form is to be poured for casting the turbine wheel. The cavity is configured for defining a hub portion of the turbine wheel and for defining blades extending from the hub portion.

The process entails providing a seed member made of the same metal composition that the wheel is to be cast from. The seed member is provided to have an equiaxed grain structure. At least a portion of the seed member is disposed within the cavity of the mold.

The process includes pouring the metal composition in molten form into the cavity such that the molten metal compositions envelops the portion of the seed member within the cavity, and controlling the process so that said portion of the seed member at least partially melts through contact with the molten metal composition and so that, upon cooling, the metal composition around the seed member solidifies with an equiaxed grain structure as precipitated by the equiaxed grain structure of the seed member.

In one embodiment, the seed member is disposed in a region of the cavity that is configured for defining the hub portion of the turbine wheel.

The seed member can have a pin configuration.

In one embodiment there is the further step, prior to the step of disposing the seed member in the mold cavity, of treating an outer surface of the seed member to remove any oxide layer and foreign substances thereon. For example, the treating step can comprise electrolytically etching the outer surface of the seed member.

In one embodiment, the controlling step comprises preheating the mold and the seed member to a mold temperature within a range between a predefined minimum mold temperature and a predefined maximum mold temperature, and ensuring that the molten metal composition at the time of pouring is at a metal temperature exceeding the maximum mold temperature.

In one embodiment the pre-heating step comprises providing a furnace and disposing the mold and the seed member within the furnace, and operating the furnace so that an internal temperature within the furnace is within said range.

In one embodiment, the predefined maximum mold temperature is selected to be below the solidus temperature for the metal composition.

The process disclosed herein can be used with various metal compositions. In one embodiment, the metal composition is selected from the group consisting of nickel-based superalloys, steels, and cobalt alloys.

In a particular embodiment, the metal composition is selected to be a nickel-based superalloy comprising (in wt %):

chromium 8-15;
molybdenum 0-5.5;
niobium+tantalum 1-3;
aluminum 5.4-6.5;
titanium 0-1.25;
carbon 0-0.2;
boron 0-0.1;
zirconium 0-0.1;
silicon 0-1;
manganese 0-0.1;
iron 0-5;
unavoidable impurities; and
nickel balance.

In another embodiment, the metal composition is selected to be a cobalt alloy comprising (in wt %):

chromium 25-30;
molybdenum 0-1;
tungsten 2-15;
carbon 0.25-3.3;
iron 0-3;
nickel 0-3;
silicon 0-2;
manganese 0-1;
unavoidable impurities; and
cobalt balance.

In still another embodiment, the metal composition is selected to be a steel comprising (in wt %):

carbon 0.1-1.1;
manganese 0.3-1.1;
phosphorus 0-0.04;
sulfur 0-0.04;
silicon 0-0.35;
oxygen 0-0.1;
nickel 0-2;
chromium 0-1.1;
molybdenum 0-0.3;
unavoidable impurities; and
iron balance.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 3A:
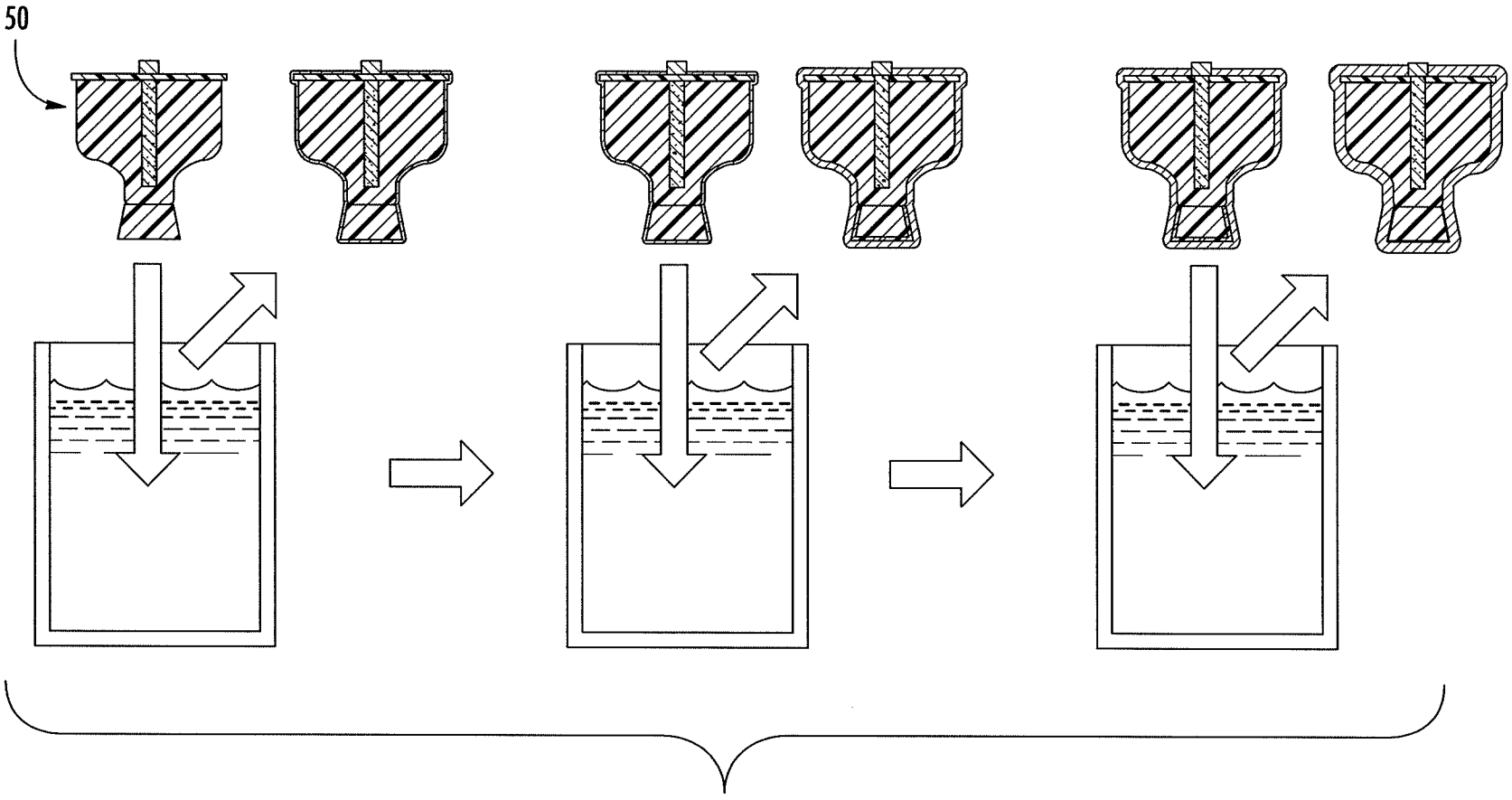
FIG. 3A illustrates a series of steps for forming a ceramic mold around the assembly of FIG. 2C.
Figure 3B:
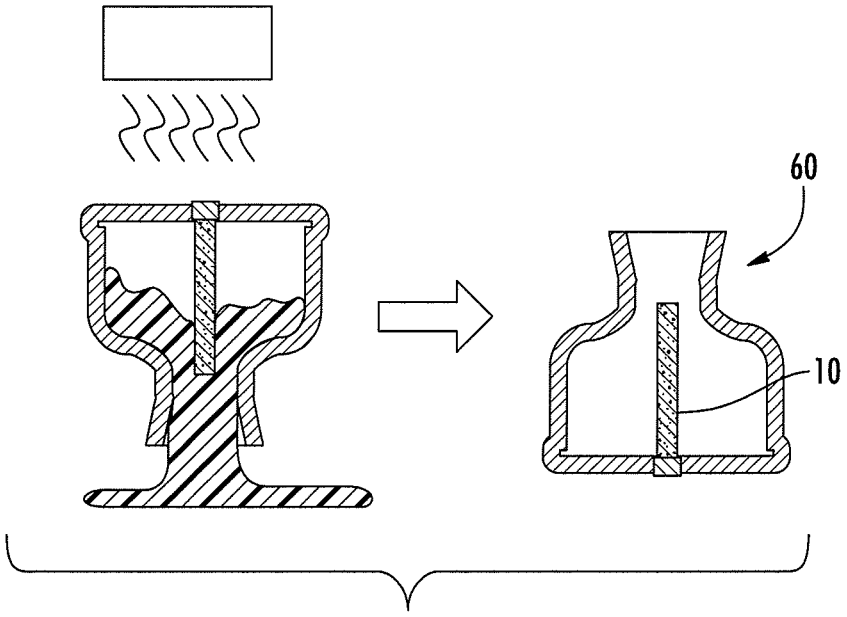
FIG. 3B depicts a process of melting away the wheel pattern and feed member from the mold, so as to leave a ceramic mold whose internal cavity is configured as a negative of the wheel pattern.
Figure 3C:
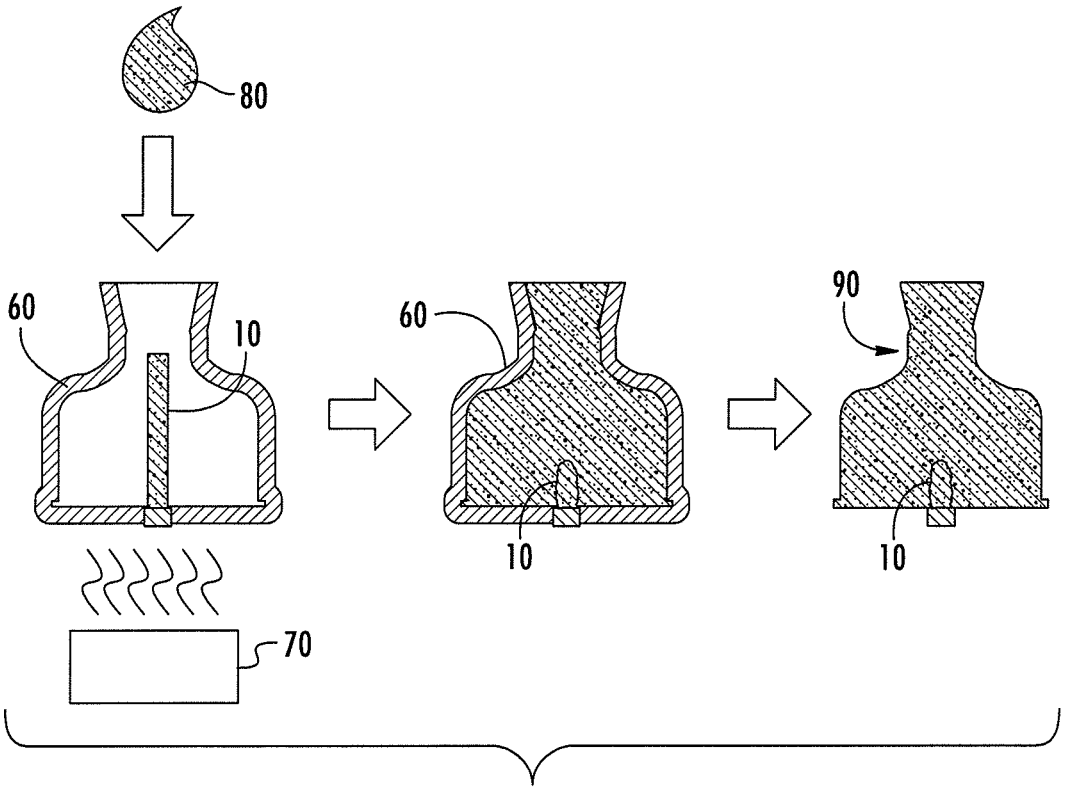
FIG. 3C depicts a process of pouring a molten metal composition, having the same composition as that of the seed member, into the cavity of the mold, followed by cooling to solidify the wheel, and finally removing the ceramic mold to leave a wheel casting.
Figure 3D:
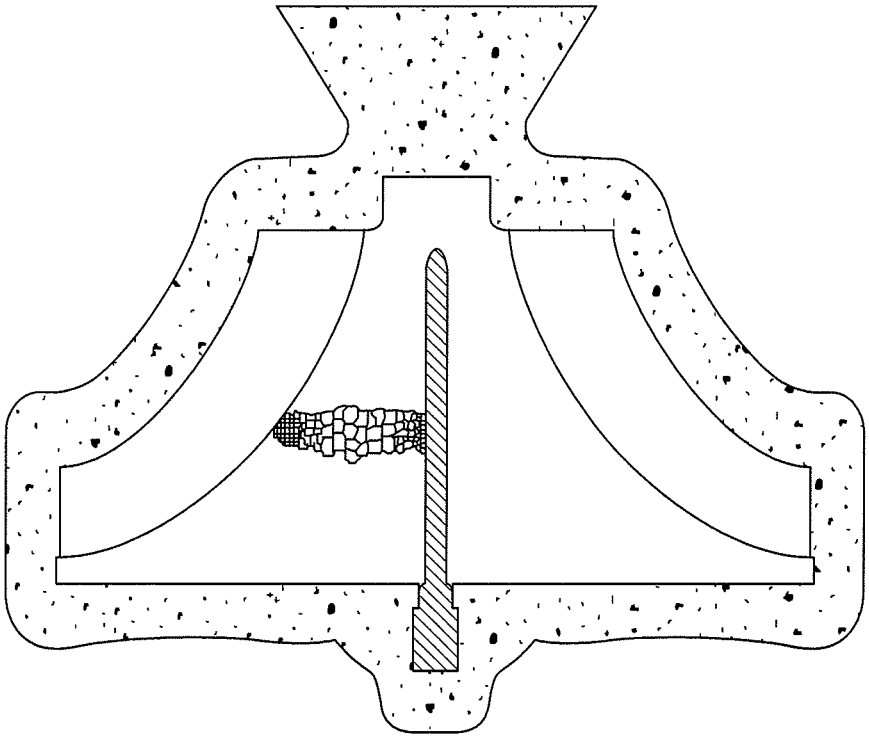
Figure 4:
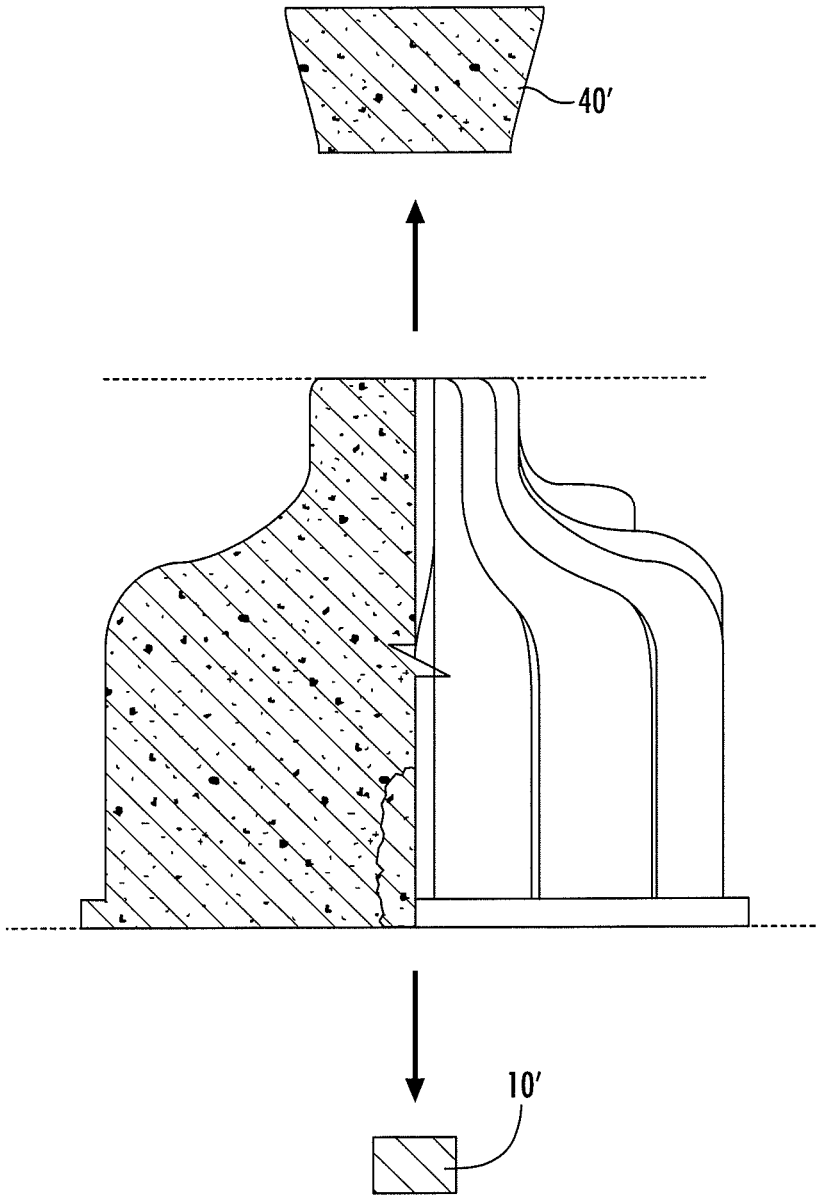

FIG. 3D schematically depicts how the fine equiaxed grain structure of the seed member is imparted to the wheel in the hub region; and FIG. 4 illustrates removal of a portion of metal corresponding to the feed member, and removal of a portion of the seed member that projects out from the hub of the wheel.

DETAILED DESCRIPTION OF THE DRAWINGS

The invention now will be described more fully hereinafter with reference to the accompanying drawings in which some but not all possible embodiments are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
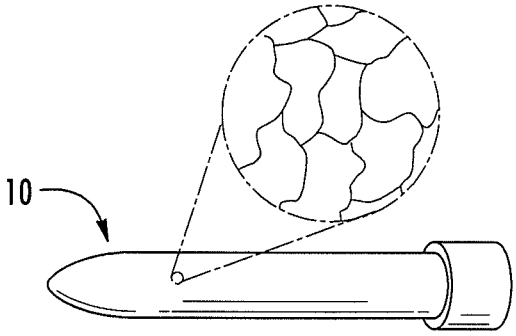
FIG. 1 is a perspective view of a seed member having an equiaxed grain structure, in accordance with an embodiment of the invention.

As noted, the process for investment casting a turbine wheel in accordance with the invention generally entails using a seed member made of the same metal composition that the turbine wheel will be cast from, and having an equiaxed grain structure that is desired to be imparted to the wheel. FIG. 1 shows such a seed member 10 in accordance with one embodiment of the invention, in which the seed member has the form of a pin. The particular configuration of the seed member in FIG. 1 is merely exemplary, and the invention is not limited to any particular configuration. The investment-casting process in accordance with the present disclosure generally entails casting the wheel around the seed member and controlling the process in such a way that the pin member at least partially melts and becomes fused in the metal of the wheel. As the metal solidifies, the equiaxed grain structure of the seed member precipitates the metal of the wheel to take on a similar equiaxed grain structure. In order to ensure that the equiaxed grain structure of the seed member is imparted to the wheel metal, an outer surface of the seed member preferably is treated to remove any oxide layer and foreign substances thereon. The treating step can comprise electrolytically etching the outer surface of the seed member.

Figure 2A:
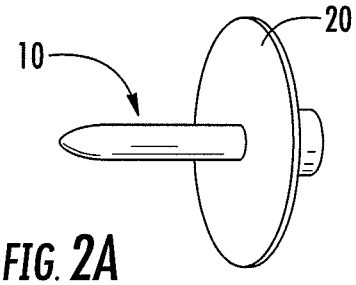
FIG. 2A depicts the seed member of FIG. 1 after having been affixed within a back disc formed of a low-melting polymer composition such as wax or thermoplastic.
Figure 2B:
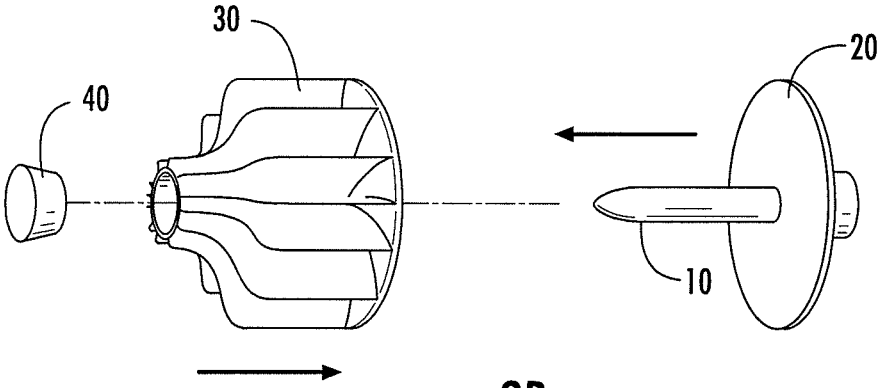
FIG. 2B illustrates a step of affixing the assembly of FIG. 2A into a positive wheel pattern and attaching a feed member onto the wheel pattern, the wheel pattern and feed member constituting a low-melting polymer composition.
Figure 2C:
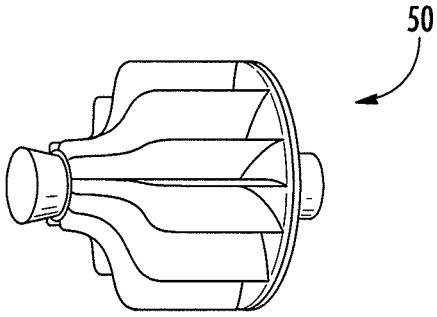
FIG. 2C shows the completed assembly of FIG. 2B.

FIGS. 2A through 2C illustrate the construction of a wheel pattern assembly 50 that will be used for forming a ceramic mold for the wheel to be cast. The wheel pattern assembly 50 includes a back disc 20 formed of a low-melting polymer material such as wax or thermoplastic. The wheel pattern assembly further includes a positive wheel pattern 30 having a configuration corresponding to the wheel to be cast, and a feed member 40, each formed of a low-melting polymer material. The wheel pattern 30, when formed of thermoplastic, includes a central bore for receiving the seed member 10 therein. In the case of a wax wheel pattern 30, the seed member 10 is embedded in the wax during the process of molding the wheel pattern, by disposing the seed member in the mold for the wheel pattern and then pouring the molten wax into the mold. In any case, with either a plastic or a wax wheel pattern, the feed member 40 is affixed to the end of the wheel pattern 30 opposite from the back disc 20, and is provided for forming a feed portion (essentially a funnel) in the mold through which the molten metal composition will be poured into the mold cavity.

The wheel pattern assembly 50 of FIG. 2C is then used for forming a ceramic mold. FIG. 3A illustrates the process for building up the ceramic mold. The wheel pattern assembly 50 is dipped a number of times into a ceramic slurry, and after each dipping the layer of slurry on the assembly is dried. In this manner, a number of layers of the ceramic material are deposited successively until the desired thickness of the mold is obtained. Typically five to 10 layers are employed.

Next, the low-melting back disc 20, wheel pattern 30, and feed member 40 are melted out of the ceramic mold as shown in FIG. 3B, leaving a ceramic mold 60 that is ready for casting. As shown, the seed member 10 is disposed within the cavity of the mold 60.

To cast a turbine wheel, the mold 60 with the embedded seed member 10 is pre-heated by a suitable heating device 70 as shown at the left in FIG. 3C, so that the mold and seed member are at a mold temperature falling within a predetermined range between a minimum mold temperature and a maximum mold temperature. The heating device 70 can be, for example, a furnace that the mold 60 is disposed within during the casting process. The mold temperature range is selected such that the maximum mold temperature is below the solidus temperature for the molten metal composition that will be poured into the mold. While the mold and seed member are thus heated to the desired temperature, molten metal 80 is poured into the mold until the mold is substantially full (middle of FIG. 3C). The temperature of the molten metal being poured is higher than the predetermined maximum mold temperature. Once the pouring is completed, the heating is discontinued and the metal composition is allowed or caused to cool and solidify. After the metal is cool, the ceramic mold 60 is broken away, leaving a wheel casting 90 (right of FIG. 3C).

In accordance with the invention, the casting process is controlled so that the portion of the seed member in contact with the molten metal composition at least partially melts through contact with the molten metal composition and so that, upon cooling, the metal composition around the seed member solidifies with an equiaxed grain structure as precipitated by the equiaxed grain structure of the seed member. This is illustrated schematically in FIG. 3D. As shown, the seed member 10 thus is partially or largely melted during the casting process so that there remains only a portion of seed member that is not fused or melded into the metal of the wheel.

Finally, as illustrated in FIG. 4, a feed portion 40' corresponding to the feed member 40 is severed from the wheel proper, and a portion 10' of the seed member 10 projecting out from the wheel hub is severed from the wheel proper. The wheel is then ready for final finishing operations and attachment to a shaft in suitable fashion.

In summary, the process in accordance with the invention allows a fine-grain structure in the thick hub region of the turbine wheel to be achieved via the assistance of the seed member, which acts two ways: (1) as a "chill pin" positioned at the center of the high-volume mass and able to absorb and dissipate heat via conduction along its length and, (2) as a source of small grain nucleation sites for the surrounding liquid metal during cooling.

The seed member during the casting process is well below the solidus temperature of the liquid metal; e.g., in the case of a nickel-based superalloy such as INCONEL® 713C the seed member can be at a temperature of about 1050° C. to 1150° C. (1920° F. to 2100° F.).

While it is unlikely to produce an entirely uniform structure throughout the full section of the wheel hub, the use of the seed member should be able to closely approximate this, such that mechanical properties are not compromised in the thick section.

Metal/mold temperatures and seed member dimensions may be contrived to cause the seed member to largely dissolve during the solidification process or at least confine any seed member residue to the centerline of the turbine wheel.

The process generally as described above can be used for casting turbine wheels from various metal compositions. It is expected that the process is applicable to at least nickel-based superalloys, steels, and cobalt alloys.

In a particular embodiment, the metal composition is selected to be a nickel-based superalloy comprising (in wt %):

chromium 8-15;
molybdenum 0-5.5;
niobium+tantalum 1-3;
aluminum 5.4-6.5;
titanium 0-1.25;
carbon 0-0.2;
boron 0-0.1;
zirconium 0-0.1;
silicon 0-1;
manganese 0-0.1;
iron 0-5;
unavoidable impurities; and
nickel balance.

In another embodiment, the metal composition is selected to be a cobalt alloy comprising (in wt %):

chromium 25-30;
molybdenum 0-1;
tungsten 2-15;
carbon 0.25-3.3;
iron 0-3;
nickel 0-3;
silicon 0-2;
manganese 0-1;
unavoidable impurities; and
cobalt balance.

In still another embodiment, the metal composition is selected to be a steel comprising (in wt %):

carbon 0.1-1.1;
manganese 0.3-1.1;
phosphorus 0-0.04;
sulfur 0-0.04;
silicon 0-0.35;
oxygen 0-0.1;
nickel 0-2;
chromium 0-1.1;
molybdenum 0-0.3;
unavoidable impurities; and
iron balance.

As previously noted, a key aspect of the investment casting process is pre-heating the mold and seed member to a mold temperature falling within a range between a predetermined minimum mold temperature and a predetermined maximum mold temperature. In the case of a nickel-based superalloy such as INCONEL® 713C, the mold and seed member can be pre-heated to about 1050° C. to 1150° C. (1920° F. to 2100° F.), which is well below INCONEL® 713C's solidus temperature of approximately 1260° C. (2300° F.).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A process for investment casting a turbine wheel to have an equiaxed grain structure, comprising steps of:

identifying a metal composition from which the turbine wheel is to be cast;

providing a mold that defines a cavity into which the metal composition in molten form is to be poured for casting the turbine wheel, the cavity being configured for defining a hub portion of the turbine wheel and for defining blades extending from the hub portion;

providing a seed member made of said metal composition, the seed member having an equiaxed grain structure;

disposing at least a portion of the seed member within the cavity of the mold, the portion of the seed member within the cavity having a pin configuration and comprising a majority of the seed member, said majority of the seed member being disposed at a center of a region of the cavity that is configured for defining the hub portion of the turbine wheel;

activating a heating device to pre-heat the mold and the seed member to a mold temperature within a range between a predefined minimum mold temperature and a predefined maximum mold temperature, followed by pouring the metal composition in molten form into the cavity such that the molten metal composition envelops said majority of the seed member; and once the pouring is completed, discontinuing the heating by the heating device and allowing the metal composition to cool and solidify;

wherein said majority of the seed member acts (1) as a chill pin positioned at a center of the hub portion of the turbine wheel and able to absorb and dissipate heat via conduction along the length of said majority and (2) as a source of small grain nucleation sites for the surrounding liquid metal during cooling, so that said majority of the seed member at least partially melts through contact with the molten metal composition and so that, upon cooling, the metal composition around the seed member solidifies with an equiaxed grain structure as precipitated by the equiaxed grain structure of the seed member.

2. The process of claim 1, further comprising the step, prior to the disposing step, of treating an outer surface of the seed member to remove any oxide layer and foreign substances thereon.

3. The process of claim 2, wherein the treating step comprises electrolytically etching the outer surface of the seed member.

4. The process of claim 1, further comprising ensuring that the molten metal composition at the time of pouring is at a metal temperature exceeding the maximum mold temperature.

5. The process of claim 1, wherein the pre-heating step comprises providing a furnace and disposing the mold and the seed member within the furnace, and operating the furnace so that an internal temperature within the furnace is within said range.

6. The process of claim 5, wherein the predefined maximum mold temperature is selected to be below the solidus temperature for the metal composition.

7. The process of claim 1, wherein the metal composition is selected from the group consisting of nickel-based superalloys, steels, and cobalt alloys.

8. The process of claim 7, wherein the metal composition is selected to be a nickel-based superalloy comprising (in wt %):

chromium 8-15;
molybdenum 0-5.5;
niobium+tantalum 1-3;
aluminum 5.4-6.5;
titanium 0-1.25;
carbon 0-0.2;
boron 0-0.1;
zirconium 0-0.1;
silicon 0-1;
manganese 0-0.1;
iron 0-5;
unavoidable impurities; and
nickel balance.

9. The process of claim 7, wherein the metal composition is selected to be a cobalt alloy comprising (in wt %):

chromium 25-30;
molybdenum 0-1;
tungsten 2-15;
carbon 0.25-3.3;
iron 0-3;
nickel 0-3;
silicon 0-2;
manganese 0-1;
unavoidable impurities; and
cobalt balance.

10. The process of claim 7, wherein the metal composition is selected to be a steel comprising (in wt %):

carbon 0.1-1.1;
manganese 0.3-1.1;
phosphorus 0-0.04;
sulfur 0-0.04;
silicon O-0.35;
oxygen 0-0.1;
nickel 0-2;
chromium 0-1.1;
molybdenum 0-0.3;
unavoidable impurities; and
iron balance.

* * * * *